United States Patent [19]

Waddington et al.

[11] 4,452,037

[45] Jun. 5, 1984

[54] AIR PURGE SYSTEM FOR GAS TURBINE ENGINE

[75] Inventors: Clive Waddington, Stratford; Normand Lagasse, Milford; Charles Kuintzle, Jr., Monroe; Donald Blake, Trumbull, all of Conn.

[73] Assignee: Avco Corporation, Stratford, Conn.

[21] Appl. No.: 368,938

[22] Filed: Apr. 16, 1982

[51] Int. Cl.[3] ..... F02C 7/06

[52] U.S. Cl. ..... 60/39.08; 184/6.11

[58] Field of Search ..... 60/39.08, 39.094, 339, 60/657, 714; 184/6.11; 251/62, 63.5; 415/175

[56] References Cited

U.S. PATENT DOCUMENTS

| | | | |
|---|---|---|---|
| 2,672,010 | 3/1954 | Newcomb | 60/39.08 |
| 3,052,444 | 9/1962 | Kintner | 251/62 |
| 3,344,602 | 10/1967 | Davies et al. | 60/39.094 X |
| 4,142,608 | 3/1979 | Sarle | 60/39.08 X |

FOREIGN PATENT DOCUMENTS

| | | | |
|---|---|---|---|
| 702551 | 1/1965 | Canada | 60/39.08 |
| 861686 | 9/1981 | U.S.S.R. | 60/39.08 |

OTHER PUBLICATIONS

Pratt & Whitney, "The Aircraft Gas Turbine and Its Operation", 6-1980, p. 126.

*Primary Examiner*—Louis J. Casaregola
*Assistant Examiner*—Donald E. Stout
*Attorney, Agent, or Firm*—Ralph D. Gelling

[57] ABSTRACT

Apparatus is disclosed for automatically purging oil from the jets supplying lubricant to bearings and seals in a turbine engine after shutdown. To accomplish this task, pressurized air is tapped from the air plenum just downstream of the engine compressor stage. The pressurized air is stored in a small tank using an air check valve in the incoming line so that the air tank is charged to the highest pressure achieved by the engine compressor during its operation. The outlet of the air tank is connected to the oil jets used for lubricating the engine bearings and seals. A snap action valve is inserted in the air supply line to activate and deactivate airflow out of the tank. The snap action valve is designed to be switched "off" whenever there is positive oil pressure in the lubricating supply line of the turbine engine. After engine shutdown, lubricant flow drops, reducing oil pressure to zero. This event initiates the start of a delay interval after which the snap action valve is activated to its "on" state allowing the contents of the air tank to be blown through the oil jets, effectively clearing them of oil.

12 Claims, 3 Drawing Figures

AIR PURGE SYSTEM FOR GAS TURBINE ENGINE

BACKGROUND OF THE INVENTION

This invention discloses means for purging oil from engine hot sections after shutdown so that coking does not occur as a result of heat soakback.

Higher specific power and improved cycle efficiency in gas turbine engines result from operating the turbine section at higher temperatures. This is basic to the nature of the Brayton cycle. Cooling techniques used on large engines do not lend themselves to easy scaling to small turbines. This results from an inability to cast or machine proportionately scaled internal cooling geometry due to minimum wall thickness requirements and an inability to reduce leakages due to seal clearance and assembly tolerance limitations.

In consequence, a small turbine engine that has been designed for low specific fuel consumption, will experience different temperature problems in the turbine section than will a similar large engine. When the turbine is shut down from a high power condition, there occurs a condition known as heat soakback. This results from the heat residing in the hottest engine sections being gradually transferred to the cooler parts of the engine through conduction, convection and radiation. During operation both air and oil cooling are used to keep operating temperature under control. After shutdown, heat is lost only through radiation and convection from the exterior surfaces of the engine. Any oil remaining in the jets or passages of the engine during the heat soakback period will be heated to the temperature of the surrounding metal. If the temperature of the oil rises to values in excess of 500 degrees Fahrenheit, coking occurs. In a small engine coking becomes a problem since the orifices at the oil jets are small. If coking occurs, the bearings and seals which the jets supply with lubricating oil tend to be starved when the engine is restarted. Lubricant starvation results in premature bearing and seal failure.

Our invention overcomes this problem in that in critical areas, both the oil lines and the jets are purged of oil each time the engine is shut down. Purging is accomplished automatically some 15 to 30 seconds after shutdown.

SUMMARY OF THE INVENTION

The lubricating system of a gas turbine engine performs two functions. First, it reduces friction at the bearing surfaces. A second purpose is to cool the surfaces with which the lubricant comes in contact. The main units of a typical system are a reservoir or tank to store the lubricant, a positive displacement pressure pump, in-line filters, flow dividers, check and pressure relief valves, various bearing drains leading to sumps, one or more oil scavenge pumps, and an oil cooler.

This invention deals with purging oil from those parts of the engine which are situated adjacent the hottest operating sections of the system. This would include the turbine drive shaft bearings and seals in the hot portions of the engine. Implementation of the invention would typically involve about six oil jets per engine where there is danger of coking in the post-shutdown heat soak period.

The air used to purge the jets is tapped off the pressurized air plenum just downstream of the compressor diffuser. The pressurized air is stored in an air tank having a check valve at its input end which ensures that the air tank holds its charge during engine shutdown. The output line from the air tank leads to a snap action time delay valve. This valve is actuated by oil pressure. Whenever the engine is turning over so that the oil pressure pump supplies lubricant, the snap action valve is maintained in the shut-off state so as to prevent flow of air out of the air tank. When the engine stops and oil pressure drops to zero, the snap action valve switches state allowing pressurized air from the air tank to flow through the oil jets effectively clearing them of their residual oil. The snap action valve has a delay interval built into its operation so that most of the oil has been drained from the seals and bearings into the sumps before air purging occurs.

With the jets blown clean, there can be no coking even though heat soakback causes post-shutdown temperatures to soar above 500 degrees Fahrenheit. On restarting the engine, experience shows that the oil pump begins delivering lubricant to all bearing and seal surfaces well before ignition occurs in the combustor. For this reason, there are no harmful effects resulting from air purging of lubricating jets in critical portions of the engine.

DESCRIPTION OF THE PREFERRED EMBODIMENT

Figure 1:
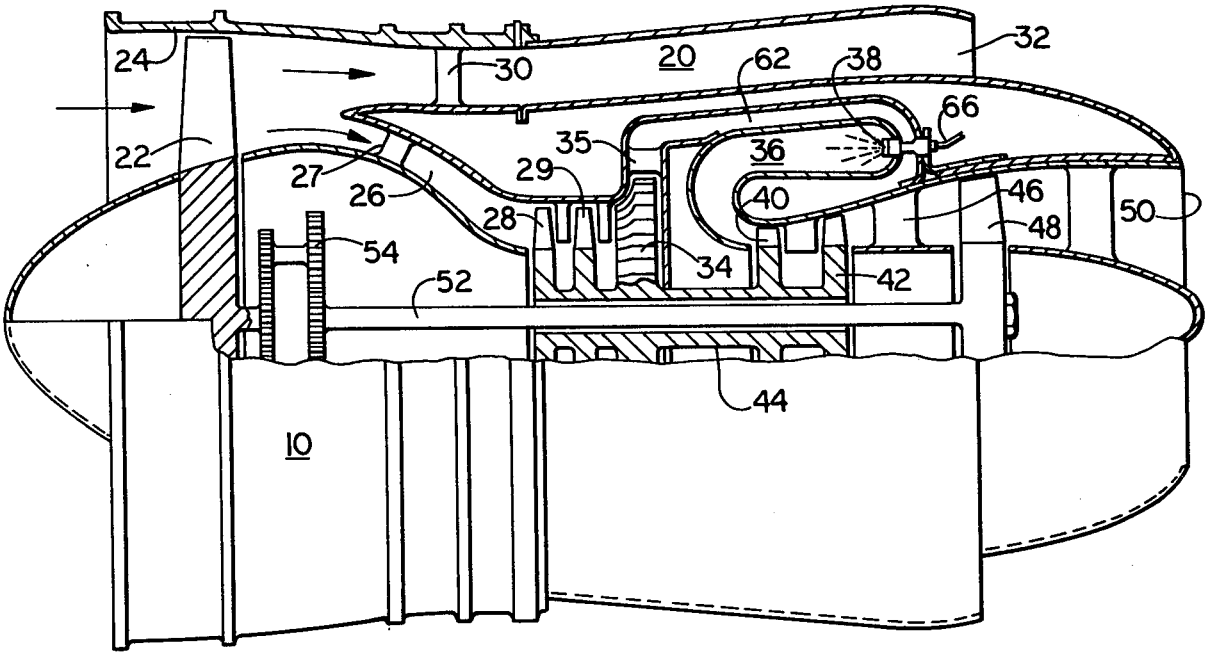
FIG. 1 is a partially cutaway view of a turbine engine typical of the type with which the invention is implemented.

FIG. 1 shows a turbine engine 10 which is typical of the type that can be improved by incorporation of our invention. Engine 10 is of the fan bypass type having a circumferential bypass region 20. Incoming air is first pressurized by fan 22. An outer shroud 24 encircles the fan. Downstream of the fan, there is a inlet passage 26 which supplies air to first compressor stage 28. Struts 27 and 30 support the passage dividing structures. First compressor stage 28 is followed by second compressor stage 29 which in turn is followed by radial impeller 34 and diffuser 35. Pressurized air from the diffuser flows into air plenum 62 which supplies combustors 36. Fuel flowing in along supply lines 66 is injected into combustor 36 via fuel nozzles 38. The hot products of combustion flow axially inward to first stage turbine disk 40. After passing first stage turbine disk 40, the hot gas stream flows through stator nozzles and has additional energy extracted at second stage turbine disk 42. Downstream of the second stage turbine is another set of stator nozzles 46 and a fan driving turbine stage 48. Turbine stage 48 drives fan 22 via shaft 52 and gear train 54. Turbine stages 40 and 42 drive the compressor stages via hollow drive shaft 44.

The still warm products of combustion escape the engine through tailpipe 50. By proper sizing of tailpipe 50 and the taper between it and bypass exhaust duct 32, the air pressure profile out of the engine can be proportioned correctly.

The bearings and seals associated with turbine stages 40, 42 and 48 will heat up when engine 10 is shut down after extended use. They are surrounded by combustors 36 which under operating conditions produce high flame temperatures therein. Our invention prevents the heat soakback cycle from becoming a problem.

Figure 2:
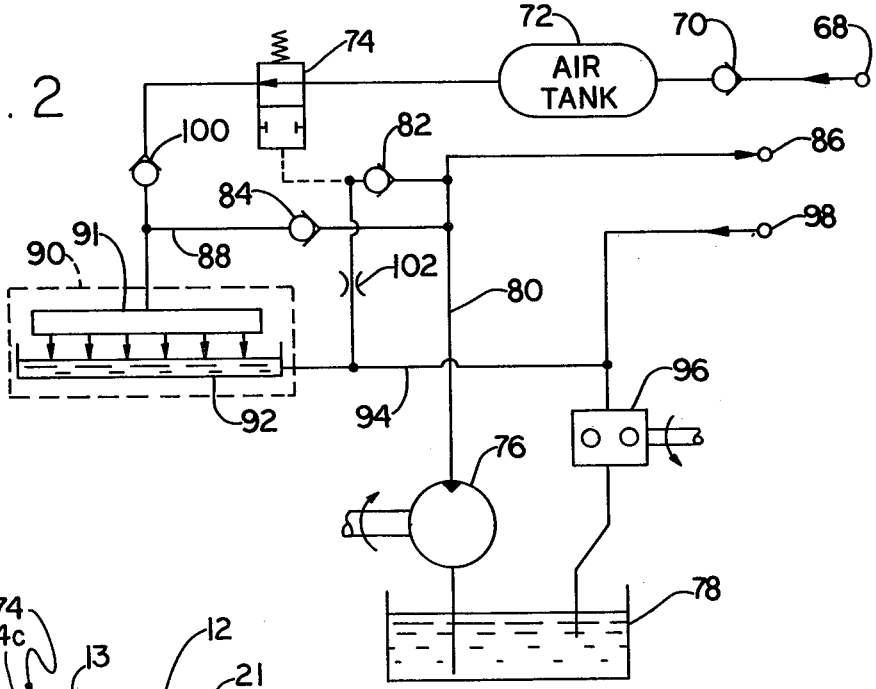
FIG. 2 is a schematic diagram of the air purging system.

Air purging of the oil jets which supply lubricant to the bearings and seals adjacent turbine stages 40, 42 and 48 is accomplished by the system disclosed in FIG. 2. A source of pressurized air 68 is obtained. This may be done by tapping air plenum 62 of engine 10. Pressurized air source 68 flows through check valve 70 into air tank 72. Air tank 72 may have volume of about 10 cu. in. and source 68 supplies air at a pressure of 140 psi max.

Snap action valve 74 is open to the passage of air when there is no oil pressure. However, when the turbine is running so as to turn the driving shaft of oil pump 76, the snap action valve 74 will be actuated to the off position, thereby preventing flow of air through the valve. Oil pump 76 accomplishes this by drawing oil out of the engine oil reservoir 78, thereby pressuring oil line 80 with lubricant. Some of the oil in line 80 passes check valve 82 and impinges on the actuating piston of snap action valve 74. Another fraction of the oil in line 80 flows through check valve 84 and onward via line 88 to the seals and bearings 90 which need protection. This is shown symbolically as comprising oil jets 91 and their respective oil sumps 92. Additionally, pressurized lubricant from pump 76 is supplied to all other parts of the engine by supply line 86.

During normal operating conditions, lubricant from the protected bearings and seal section 90 is returned to the reservoir 78 via scavenge line 94 and scavenge pump 96. Lubricant return 98 symbolizes the return line from all other parts of the engine. It will be understood that in actual practice there would probably be an oil cooler between scavenge pump 96 and reservoir 78.

Check valve 100 is inserted in the air line leading from the snap action valve 74 to oil jets 91 in order to prevent lubricant from backing up into valve 74 during turbine running conditions.

When the turbine engine is shut down and oil pump 76 slows to a stop, no more lubricant is delivered through line 80. Lubricant delivery to oil jets 91 via check valve 84 stops. Check valve 82, however, prevents the pressure on the piston actuator of snap action valve 74 from dropping in synchronism with that in line 80. Therefore, even though no further lubricant is being supplied, oil pressure remains behind check valve 82 to keep snap action valve 74 in the off condition. This allows residual lubricant in oil line 88 to drain down through jets 91 on shutdown of the engine.

Lubricant pressure on snap action valve 74 does decrease slowly after engine shutdown. This happens because of capillary 102 which slowly bleeds off lubricant passed through check valve 82. Capillary 102 is sized to let pressure on snap action valve 74 drop to its switching value some 15 to 30 seconds after the turbine engine reaches a complete stop. When the pressure on the snap action valve 74 drops to its switchover value, air from air tank 72 is released to flow through check valve 100 and on into jets 91. Since the initial air pressure in air tank 72 is in excess of 100 psi, the sudden burst of air released through jets 91 quickly clears them of residual lubricant. Check valve 84 prevents air from purging lubricant from the main oil supply line 80. Lubricant blown out of jets 91 will be collected in the oil sumps 92 and thereafter drain back through the scavenge system lines. In this way, heat soakback does not result in lubricant gradually being turned to coke in the jets 91.

Figure 3:
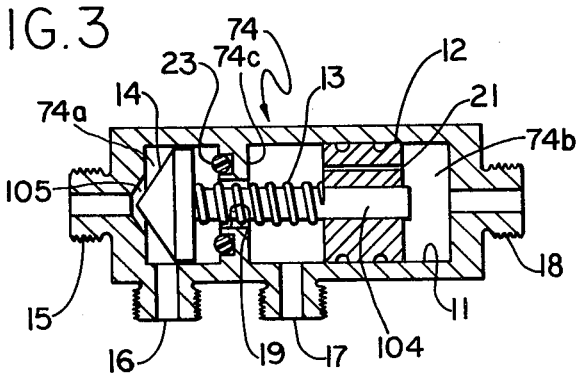
FIG. 3 is an enlarged cross sectional view of one implementation of the snap action valve having a built-in time delay.

As best shown in FIG. 3, the hollow interior cylinder 11 of snap action valve 74 is divided into two compartments 74*a* and 74*b* by partition 74*c*. A valve member is mounted within the cylinder 11 and consists of an actuating piston 12 slidably mounted on a shaft 104 and a stopper 14 secured to one end of shaft 104. Sliding piston 12 is biased away from stopper 14 by a spring 13 mounted on shaft 104 and moves within compartment 74*b*. Stopper 14 is conically shaped to engage valve seat 105 in sealed relation and moves within compartment 74*a*.

Functionally, fitting 18 of FIG. 3 would be connected to the output side of check valve 82 (See FIG. 2). Air inlet 15 will connect with the outlet end of air tank 72. Air outlet 16 connects to the inlet of check valve 100. Oil outlet 17 connects with scavenge line 94 (same as connection of capillary 102 in FIG. 2 showing). When stopper 14 is in the seated position (towards the left in FIG. 3), air is prevented from flowing in at inlet fitting 15 and outward through outlet fitting 16. Any oil reaching the left side of piston 12 is free to flow outward through oil outlet 17 which is connected to the scavenge return lines, as shown. An orifice 21 drilled through piston 12 provides a small positive flow of lubricant through the valve. Orifice 21 accomplishes the function symbolically shown as capillary 102 of FIG. 2.

In operation, start-up of the turbine creates oil pressure build-up long before there is any pressurized air stored in air tank 72. As oil begins to flow through check valve 82 and into compartment 74*b* of cylinder 11 of snap action valve 74, piston 12 and stopper 14 are urged towards the left in FIG. 3. The force urging the closure of stopper 14 against the seat 105 is proportional to the oil pressure multiplied by the cross sectional area of piston 12. By making the cross sectional area of piston 12 large with respect to the area of the seat 105 at the air inlet end of the snap action valve 74, there is no tendency for the valve to switch states during engine operation even when air pressure in air tank 72 equals or exceeds operating oil pressure.

The rising oil pressure supplied through check valve 82 first pushes the piston 12 to the left in FIG. 3 forcing conical member 14 against the seat 105 to close the valve. The oil pressure then pushes the piston 12 to the end of its travel, while compressing the spring 13. Oil leaking through the orifice 21 in the piston 12 is returned to the reservoir 78 through the scavenge system. The stopper 14 can be designed with an elastomeric seat to give zero air leakage when the valve is closed.

When the engine stops running, the status changes. Pressure in air tank 72 is held at a high value by air check valve 70. Conversely, pressure in cylinder 11 gradually bleeds off through orifice 21. As the oil pressure on the right side of piston 12 drops, the force tending to keep conically shaped stopper 14 against its seat declines. When the residual oil pressure is exceeded by the restoring force of the pressure of the air multiplied by the cross sectional area of the seat 105, the valve 74 begins to open. Experience shows that both the opening and closing action of the valve 74 is abrupt and positive. The opening action of valve 74 is enhanced by the fact that the effective cross sectional area of the conical shaped stopper 14 increases several fold once it moves away from the seat. Increase in the area over which air pressure is applied then forces the valve piston to move quickly to the right stopping only when the back side of conical shaped stopper 14 impacts an elastomeric O-ring 23. Use of an O-ring serves to prevent leakage of air through opening 19 in the partition 74*c*.

When the engine is shut down, the oil in compartment 74*b* of cylinder 11 is trapped by the closure of check valve 82 and can only leak away through the orifice 21 under the action of the spring 13. The orifice 21 and the spring 13 are designed so that it takes approximately 15 seconds for the piston to move its total travel. The preload on the spring 13 is sufficient to keep the valve closed against the maximum anticipated air pressure.

The piston 12 and shaft 104 on which it slides are configured so that a groove (not shown) on the right end of the shaft 104 allows the remaining oil pressure to be more rapidly dumped once the piston 12 reaches a point near the limit of its travel. With oil pressure reduced to a critical level and the spring 13 no longer in compression, air pressure at the conical seat 105 forces the valve 74 to open. With no spring force to impede further motion and the rate of oil pressure drop no longer limited by orifice 21, the valve snaps open with conical shaped stopper 14 resting against O-ring 23. This snap action prevents loss of air into the scavenge line.

With the lubricant purged before heat soakback can raise temperatures to critical values, no coking will occur. Test results show that whenever heat soakback raises temperatures of oil coated parts above 500 degrees F., there will be coking and formation of a varnish like residue with all regularly used types of turbine engine lubricants. By purging of the oil jets with air, there is no coke clogged jets awaiting engine restart. By using a positive displacement oil pump, lubricant begins flowing to all components by the time that the starting motor has the engine rotating at 10 percent rated rpm. This keeps bearing and seal wear to a minimum.

While only limited embodiments of the invention have been presented, various modifications will be apparent to those skilled in the art. Therefore, the invention should not be limited to the specific illustration disclosed, but only by the following claims.

We claim:

1. Apparatus for directing air through the jets of a bearing and seal oil supply system for a gas turbine engine to purge the oil from the jets into the scavenge conduit of said system, each of said jets having a supply conduit for directing oil to said jet, said apparatus comprising:

a source of pressurized air connected to a first conduit;

a reservoir connected to the first conduit to receive and store a predetermined amount of pressurized air;

an air pressure control valve connected in the first conduit to maintain the air in the reservoir at a predetermined value;

a second conduit connecting the reservoir to the supply conduit of the jet;

a valve means connected in the second conduit to control the flow of pressurized air to the oil supply conduit of the jet, said valve means operatively connected to the oil supply system to close the second conduit when the oil supply system is pressurized and to open the second conduit when the oil pressure in the oil supply system dissipates after shutdown of the gas turbine engine; and means operatively associated with the valve means to delay the opening of the second conduit for a predetermined period after engine shutdown.

2. Apparatus for purging the jets of a bearing and seal oil supply system for a gas turbine engine as described in claim 1 wherein the control valve means includes a snap action valve comprising:

a cylindrical body having first and second chambers, said first chamber having an inlet connected to the oil supply system, said second chamber having an inlet and an outlet connected in the path of the second conduit; and a valve closure assembly slidably mounted in the cylindrical body for movement between open and closed positions, said assembly including a shaft extending into both of said chambers and further comprising:

a stopper fixed to one end of the shaft for movement therewith within the second chamber to open and close the second conduit;

a piston mounted on the shaft for movement therewith within the first chamber, said piston being responsive to the presence of pressurized oil in the oil supply system to move the valve closure assembly to the closed position; and means operatively associated with the valve closure assembly to return said assembly to the open position responsive to the absence of pressurized oil in the oil supply system.

3. Apparatus for purging the jets of a bearing and seal oil supply system for a gas turbine engine as described in claim 2 wherein the delay means comprises:

means to maintain the presence of the pressurized oil in the first chamber after the engine is shut down; and means to allow the pressurized oil maintained in said first chamber to gradually leak into the scavenge conduit.

4. Apparatus for purging the jets of a bearing and seal oil supply system for a gas turbine engine as described in claim 3 wherein the means to maintain the presence of the pressurized oil is a check valve connected to the inlet of the first chamber.

5. Apparatus for purging the jets of a bearing and seal oil supply system for a gas turbine engine as described in claim 3 wherein the leakage means comprises a capillary tube.

6. Apparatus for purging the jets of a bearing and seal oil oil supply system for a gas turbine engine as described in claim 5 wherein the first chamber is constructed with an outlet connected to the scavenge conduit of the oil supply system, said outlet being positioned on the opposite side of the piston from the inlet of the first chamber to provide a vent for both of the chambers.

7. Apparatus for purging the jets of a bearing and seal oil supply system for a gas turbine engine as described in claim 6 wherein the capillary tube is constructed in the piston to allow oil to leak therethrough and vent through the outlet of the first chamber.

8. Apparatus for purging the jets of a bearing and seal oil supply system for a gas turbine engine as described in claim 2 wherein the first chamber is constructed with an outlet connected to the scavenge conduit of the oil supply system, said outlet being positioned on the opposite side of the piston from the inlet of the first chamber to provide a vent for both of the chambers.

9. Apparatus for purging the jets of a bearing and seal oil supply system for a gas turbine engine as described in claim 8 wherein in the open position the stopper operates to close the second chamber from the first chamber.

10. Apparatus for purging the jets of a bearing and seal oil supply system for a gas turbine engine as described in claim 2 wherein the piston is slidably mounted on the shaft, said piston being biased away from the stopper by means of a spring.

11. Apparatus for purging the jets of a bearing and seal oil supply system for a gas turbine engine as described in claim 10 wherein the biasing spring is compressed when the piston is moved by the presence of oil in the first chamber, said biasing spring constructed to force the stopper into the closed position and maintain said position during the presence of oil in the first chamber.

12. Apparatus for purging the jets of a bearing and seal oil supply system for a gas turbine engine as described in claim 11 wherein the return means is provided by a combination of forces exerted on the piston by the biasing spring and the air pressure acting on the stopper.

* * * * *